United States Patent [19]

Fehrs

[11] Patent Number: 4,749,115

[45] Date of Patent: Jun. 7, 1988

[54] MAGAZINE FOR A POWER-DRIVEN DRIVE-IN APPARATUS FOR THE ACCOMMODATION OF PINS OR NAILS OR THE LIKE

[75] Inventor: Hellmuth Fehrs, Hamburg, Fed. Rep. of Germany

[73] Assignee: Joh. Friedrich Behrens AG, Ahrensburg, Fed. Rep. of Germany

[21] Appl. No.: 940,270

[22] Filed: Dec. 11, 1986

[30] Foreign Application Priority Data

Dec. 14, 1985 [EP] European Pat. Off. ..... 85115990.5

[51] Int. Cl.[4] ..... B25C 1/04

[52] U.S. Cl. ..... 227/109; 227/127

[58] Field of Search ..... 227/109, 120, 127

[56] References Cited

U.S. PATENT DOCUMENTS

| | | | |
|---|---|---|---|
| 3,720,364 | 3/1973 | Maestri | 227/109 |
| 4,174,802 | 11/1979 | Maestri | 227/109 |
| 4,304,349 | 12/1981 | Novak et al. | 227/109 |
| 4,319,705 | 3/1982 | Geist et al. | 227/120 |
| 4,375,867 | 3/1983 | Novak | 227/109 |

FOREIGN PATENT DOCUMENTS

| | | |
|---|---|---|
| 1091500 | 6/1956 | Fed. Rep. of Germany . |
| 1946587 | 9/1969 | Fed. Rep. of Germany . |
| 2743906 | 4/1979 | Fed. Rep. of Germany . |
| 3201706 A1 | 9/1983 | Fed. Rep. of Germany . |
| 3208354 A1 | 9/1983 | Fed. Rep. of Germany . |
| 2024691 A | 1/1980 | United Kingdom . |

*Primary Examiner*—E. R. Kazenske
*Assistant Examiner*—James L. Wolfe
*Attorney, Agent, or Firm*—Faegre & Benson

[57] ABSTRACT

A magazine for a power-driven drive-in apparatus for the accommodation of pins or nails, especially headless nails or pins, comprising a guiding channel the roof wall of which is adapted to assume different heights vis-à-vis the bottom wall for adaptation to the lengths of the pins or nails. A side wall of the guiding channel is formed by at least one longitudinal surface of a lamination which is supported in the upper region of the guiding channel to be capable of limited movement along an axis transverse to the longitudinal axis of the guiding channel and is biased by a spring in a direction towards the other side wall. A lateral covering rail when in a retracted position releases the guiding channel to be charged from the side with its guide designed in such a manner that with the covering rail in the closed position the longitudinal surface of the lamination either lies in close contact against the other side wall or against the upper ends of the nails or pins, and in the partially or entirely opened rearward position the lamination is spaced through a distance from the other side wall.

14 Claims, 9 Drawing Sheets

MAGAZINE FOR A POWER-DRIVEN DRIVE-IN APPARATUS FOR THE ACCOMMODATION OF PINS OR NAILS OR THE LIKE

The invention relates to a magazine for a power-driven drive-in apparatus for the accommodation of pins or nails, especially of headless pins or nails, comprising a guiding channel defined by spaced side walls, a bottom and a roof wall, said roof wall being adapted to assume different heights with respect to the bottom wall for adaptation to the length of the pins or nails, and a spring-biased feeder advancing the pins or nails in the guiding channel to a shooting channel in the muzzle tool of the drive-in apparatus.

With conventional drive-in apparatuses the drive-in plunger which drives the fastener into a workpiece, is actuated electrically, pneumatically or by spring force. The fasteners, such as staples, nails or pins, for example, are magazinized in a magazine mostly in the form of strips and fed to the drive-in or shooting channel by means of a feeder. The magazines mostly are elongated members having a guiding channel in the interior thereof, which is roughly adapted to the profile of the fastener. With nails or pins, there is provided a correspondingly narrow guiding channel along which they are moved by the feeder. The nails or pins are guided as far as possible not only from below but also from above. With nails or pins of different lengths, however, a corresponding change of height is required for the guide, which may be obtained through corresponding manipulations at the magazine.

With the magazine mentioned at the beginning a rail forming the roof wall for the guiding channel is suspended in a manner to be adjustable in height. A rod which may be actuated by means of a button and arrested in different heights is connected to the rail and has to be adjusted in case of a different length of nail or pin. With the known conception, only relatively wide leaps may be permitted for the lengths of pin. The actuation button projects relatively wide upwards from the upper surface of the magazine and may impair the handling of the drive-in apparatus (German disclosure letter No. 27 43 906).

A magazine for a drive-in apparatus has furthermore become known in which a fixedly incorporated guide may accommodate nails of two different lengths and provided with a head (German disclosure letter No. 29 26 881). For headless nails or pins the known magazine is not suited.

It is therefore the object of the invention to provide a magazine for a power-driven drive-in apparatus, which accommodates also headless pins, nails or the like of different lengths, without any manipulation having to be effected at the magazine.

This object is attained in accordance with the invention in that one side wall is formed by the longitudinal surface of at least one lamination which is supported in the upper region of the guiding channel to be capable of limited movement along an axis transverse to the longitudinal axis of the guiding channel, and is biased by means of a spring in a direction towards the other side wall, a covering rail forming a lateral boundary being guided by means of a rail guide at the magazine longitudinally of the guiding channel and in a retracted position releasing the guiding channel to be charged from the side, the rail guide and the covering rail being designed in such a manner that with the covering rail in its forward closed position the longitudinal surface of the lamination either lies close to the other side wall or is slightly spaced therefrom, respectively, or at the upper ends of the nails or pins and in the partially or fully opened rearward position, the lamination is spaced through a distance from the other side wall which is greater than the diameter of the shank or the head of the pins or nails.

The magazine according to the invention is charged from the side with the covering rail open. In case of adjustment from the closed into the open position or vice versa, the covering rail performs a lateral movement approximately in parallel with itself. In the upper region of the guiding channel, a region of the side wall is formed by at least one lamination which is biased with the aid of a spring in a direction towards the other side wall. If there is no nail present in the guiding channel, the lamination lies in close contact against the other side wall or is slightly spaced therefrom, when the covering rail is in its forward closed position. In the partially or fully opened position of the covering rail, however, there is a space between the lamination and the other side wall, said space being dimensioned such as to be greater than the head or the diameter, respectively, of the shank of the nail or pin to be accommodated. The underside of the lamination, thus, forms an upper guide for nails and pins, the length thereof corresponding approximately to the height of the guiding channel as far as the underside of the lamination. If the length of the nail or pin is greater, the lamination will be automatically pushed back against the spring by the upper ends of the nails or pins upon closure of the covering rail, so that a guiding surface disposed above the lamination will take over function as an upper guide. With only one lamination present, an automatic adaptation to nails or pins of two different lengths is obtained in this manner. If, for instance, three superimposed laminations are used, an adaptation to four pin lengths may be effected. It goes without saying that the thickness of the laminations is selected to be such that an adaptation to standard lengths of pin or nail is obtained.

The covering rail is suitably held by an elongated supporting member connected to the drive-in apparatus.

The lamination may be supported in the supporting member or in the covering rail. To be preferred is the arrangement of the lamination in the covering rail. For this purpose, according to one embodiment of the invention, the lamination is supported in a guide in the covering rail. The guide comprises a guiding recess opening towards the guiding channel, with the upper guide wall nearly abutting against the other wall of the guiding channel. Besides, the laminations are supported for limited movement in such a manner that the wall surface thereof facing the guiding channel is aligned with the upper guiding surface, when the covering rail is in entirely or partially opened position.

The lamination is supported to be capable of limited lateral movement. A simple guide may consist in that two elongated holes spaced from each other are formed in the lamination with the pins passing therethrough. The laminations may be formed of metal or synthetic material. The spring biasing the laminations, for example, is a leaf spring or beam spring. With laminations formed of metal, the leaf spring is a separate constructional member which is fastened at the lamination by suitable fastening means. If, however, the lamination is formed of synthetic material, the leaf spring may be formed integrally therewith.

In one embodiment of the invention, the covering rail is approximately C-shaped in cross section. The free edges thereof are sliding in upper and lower grooves of a supporting structural member. So that the lateral movement of the C-shaped covering rail as above described may be obtained, the grooves are provided with a width greater than the thickness of the edges of the covering rail over the better portion of the length thereof, which edges are engaging within the grooves. Adjacent to the shooting channel, however, the grooves are provided with a laterally offset portion. Furthermore, the front and rear ends of the covering rail are provided with thickened portions, the thickness of which corresponding to the width of the grooves, approximately. The thickened portions take care that the covering rail is axially guided in the supporting structural member while being laterally fixed. In the partially or entirely opened position, thus, the forward thickened portions take care that the lamination is spaced from the other wall through the distance as described above. In the closed position, the forward thickened portions move into the offset groove portion, and the rearward thickened portions enter into the guiding grooves, so that thereby the lateral offset movement of the covering rail occurs as described and the lamination may approximately or entirely approach the opposite guiding channel wall. But if, however, a nail is present in the region of a lamination, the lamination will place itself resiliently against the nail.

The lower guide for the nails or pins is preferably formed by a lateral lug of the supporting structural member. On this lateral lug there may also be fitted a guiding ledge for the inverted U-shaped feeder.

In case of jams in the lower region of the drive-in channel it is advantageous when the rearward portion of the muzzle tool is connected to the covering rail in the lower region thereof. Through a displacement of the covering rail to the rear, thus, the lower region of the drive-in channel becomes free. The jammed fastener may be removed. So that a fastener may be freed which is jammed also in the upper region of the drive-in channel, provision is made in one embodiment of the invention that the supporting structural member is guided at the forward end thereof by means of a relatively short guiding member fitted at the muzzle tool, and is adapted to be fastened at the muzzle tool by means of a screw. The supporting structural member is furthermore fastened in the rearward structural member by means of another screw said screw being passed through an elongated hole in the supporting structural member. If both the two screws as mentioned are loosened, the supporting structural member may be pulled to the rear through a short distance thus releasing the upper region of the drive-in channel.

The magazine according to the invention may be used for nails and pins with head or without. In the case of pins or nails having a head the wall portion opposite the lamination preferably is provided with a deepening extending the length of the guiding channel.

The invention will be explained in the following in more detail by way of drawings.

Figure 1:
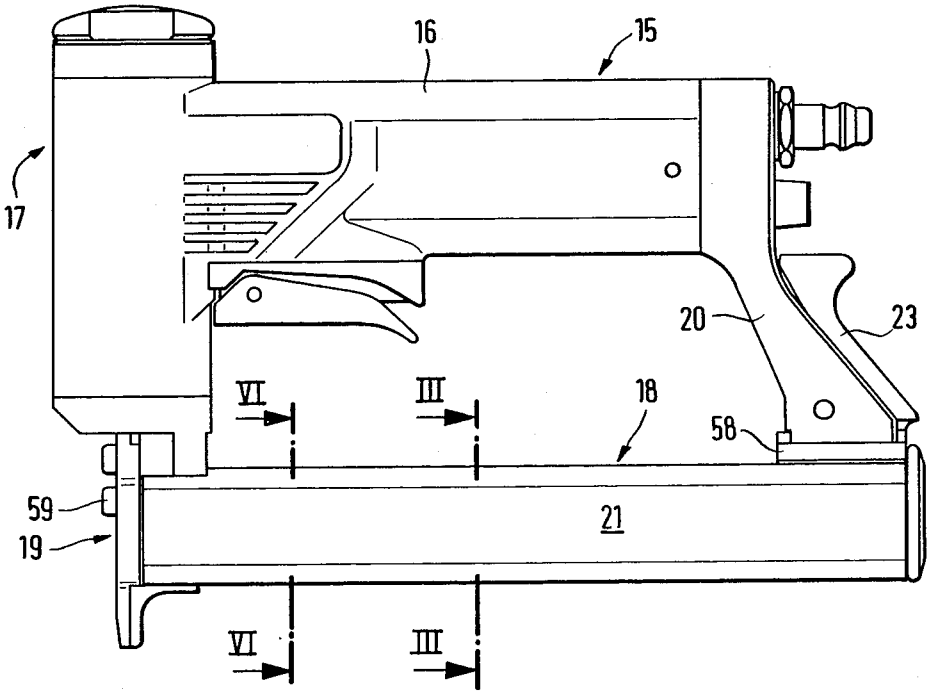
FIG. 1 shows a lateral view of a drive-in apparatus having a magazine according to the invention.

Prior to enlarging in more detail on the individual representations shown in the drawings, it is to be stated that each of the features described is of inventively essential significance by itself or in connection with features of the claims.

FIG. 1 shows a compressed air-operated drive-in apparatus 15, comprising an upper handle portion 16, a driving portion 17 as well as a magazine 18. The elongated magazine 18 extends between a muzzle tool 19 and a holding member 20 connected to the rear end of the handle portion 16. From FIG. 2 it will be seen that a covering rail 21 of the magazine 18 is in part pushed back. It will be noted that a nose 22 is provided at the upper rear end of the covering rail 21 which cooperates with an interlocking means provided at the holding member 20, said interlocking means being operated by an interlocking lever 23. Such an interlocking arrangement, however, is known and will not be described any more in the following. From FIG. 2 one will furthermore recognize an elongated supporting structural member 24.

Figure 4:
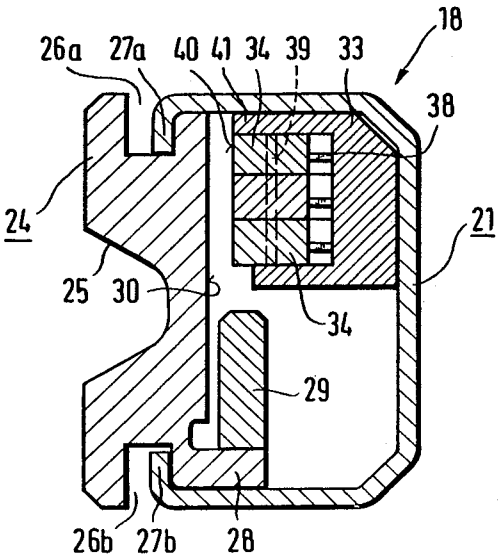
FIG. 4 shows a sectional view taken along line 4—4 of the representation shown in FIG. 2.
Figure 3:
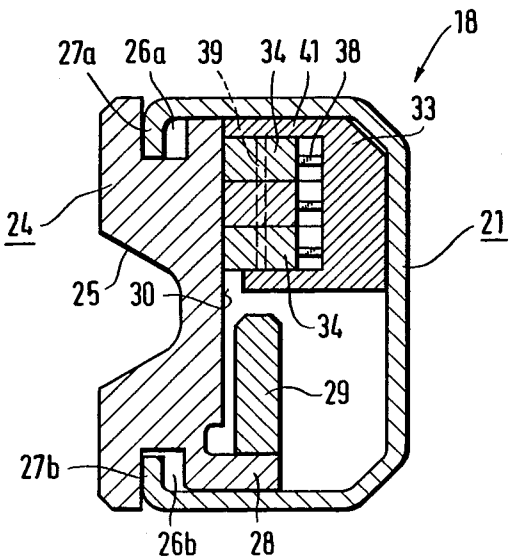
FIG. 3 shows a sectional view taken along line 3—3 of the representation shown in FIG. 1.

The construction of the magazine 18 may be seen in more detail from the sectional views of the FIGS. 3, 4, 6 and 7. The supporting structural member 24 which, to save on the material, is constricted in the center at 25, has an upper groove 26*a* and a lower groove 26*b*. The covering rail 21 is C-shaped in cross section. Its inward bent free edges 27*a*, 27*b* engage within the grooves 26*a*, 26*b*. The thickness of the free edges 27*a*, 27*b* is substantially less than the width of the grooves 26*a*, 26*b*. The legs of the covering rail 21 come to lie against the portions of the supporting structural member 24 which are disposed inwardly of the rail 21, so that the rail 21 in case of lateral movement transverse to the longitudinal axis relative to the supporting structural member 24 as shown in FIGS. 3 and 4, will be guided by the supporting structural member.

The supporting structural member 24 is provided with a lug 28 at the lower portion thereof disposed in the rail 21, with a guiding ledge 29 fitted thereon. As will be noted especially from FIGS. 6 and 7, an inner surface 30 forms the one side wall of a guiding channel for the pins 31. The lower boundary of the guiding channel is defined by the upper surface of the lug 28. In the lower region thereof the guiding channel is defined on its side opposite the surface 30 by the facing side of the guiding ledge 29. An inverted U-shaped feeder 32 rests on the guiding ledge which cooperates with a spring in a manner not described in any more detail. The inner leg of the feeder 32 gets into engagement with the rearmost pin 31.

Figure 10:
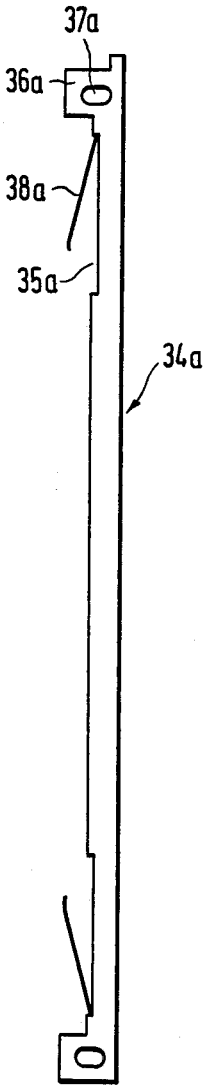
FIG. 10 shows a top plan view taken on alamination for the magazine according to the invention made of metal.
Figure 11:
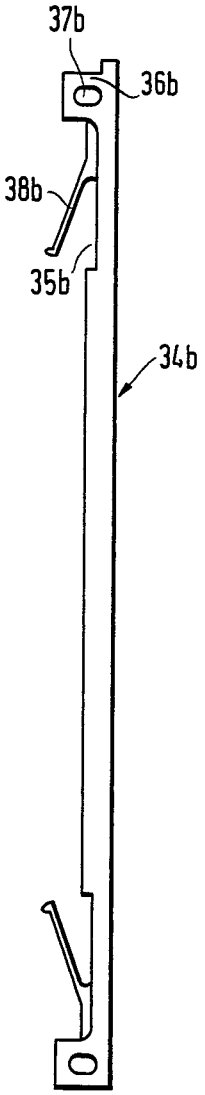
FIG. 11 shows another embodiment of a lamination for the magazine according to the invention made of synthetic material.

Fastened in the upper region of the covering rail 21 at the inside thereof in a manner not shown in any more detail, is a guiding structural member 33. Said member being a horizontal U-profile in cross section with the recess facing the guiding channel. Supported in the recess is a pack of three laminations 34 of rectangular cross section. The construction of the laminations may be recognized in more detail from FIGS. 10 and 11. FIG. 10 shows a lamination **34*a* of metal, and FIG. 11 shows a lamination 34*b* of synthetic material. The laminations 34*a*, 34*b* are flat rods over the better portion of their length with a rectangular cross section. At the ends thereof, they are recessed as shown at 35*a* and 35*b*, respectively. The recess is joined by a lug 36*a* and 36*b*, respectively. Formed in the lugs 36*a* and 36, respectively, are elongated holes 37*a* and 37*b*, respectively. Beam springs 38*a* and 38*b*, respectively, are arranged in the recesses. The beam spring 38*a* is fastened by welding or riveting or also with the aid of a screw. The beam spring 38*b* is formed in one piece with the lamination 34*b*. A guiding pin respectively extends through a lamination pack through the elongated holes 37*a* and 37*b*, respectively, at the ends thereof, which is shown at 39 in dashed lines in FIGS. 3, 4 and 6. The pins 39 are connected to the legs of the guiding member 33. The beam springs 38 of the laminations 34 are supported on the bottom of the recess, thus urging the laminations 34 in a direction towards the opposite guiding channel wall 30. The elongated holes 38 limit the end position. In this position the longitudinal faces 40 of the laminations 34 facing the guiding channel are in alignment with the end face of the upper leg 41 of the guiding member 33. It will be noted from FIGS. 3, 4 and 6 that the covering rail 21 is adapted to assume two limit positions relative to the supporting structural member 24. According to the representation in FIGS. 3 and 6, the two members are displaced in a direction towards each other to the maximum extent. This is the case with the covering rail 21 closed according to FIG. 1. In FIG. 4 the covering rail 21 and supporting structural member 24 are spaced from each other to the maximum extent. This is the case with the covering rail 21 partly opened according to FIG. 2**.

Figure 9:
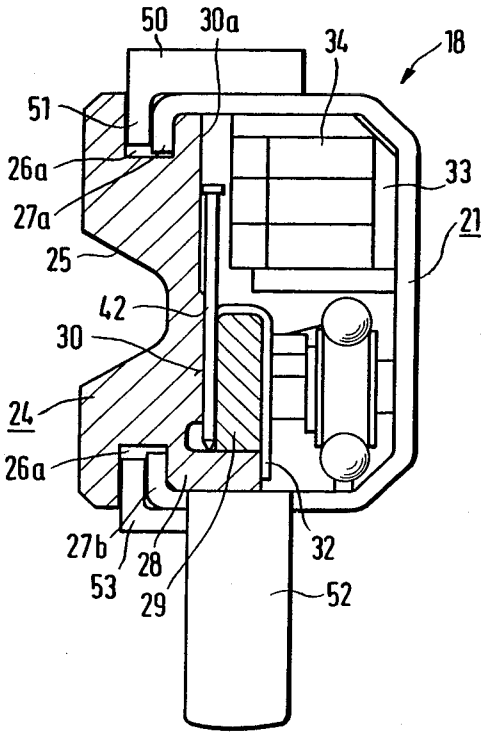
FIG. 9 shows a sectional view similar to FIG. 7, however, for nails having heads.
Figure 8:
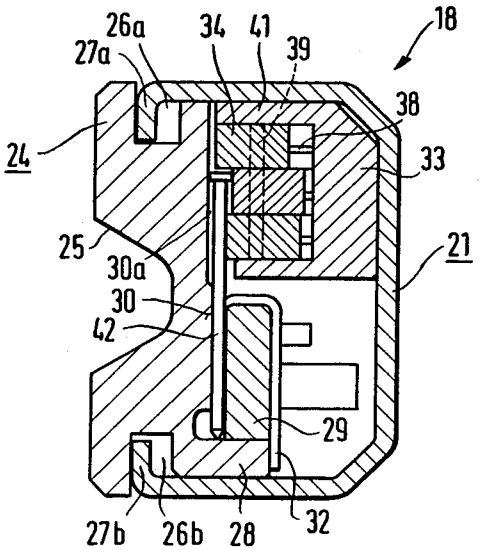
FIG. 8 shows a sectional view similar to FIG. 6, however, for nails having heads.

FIGS. 8 and 9 show an alternative embodiment of the magazine described above. The sectional views are similar to those of FIGS. 6 and 7 and, as far as like components are shown, like reference numerals have been used. The only difference with the FIGS. 8 and 9 consists in that a deepening is formed in the upper region of the guiding channel wall 30, extending the length of the supporting structural member 24. The deepening in part accommodates the head of a nail 42. The deepening **30*a*** prevents nails with heads from being guided while in a canted position.

Figure 5:
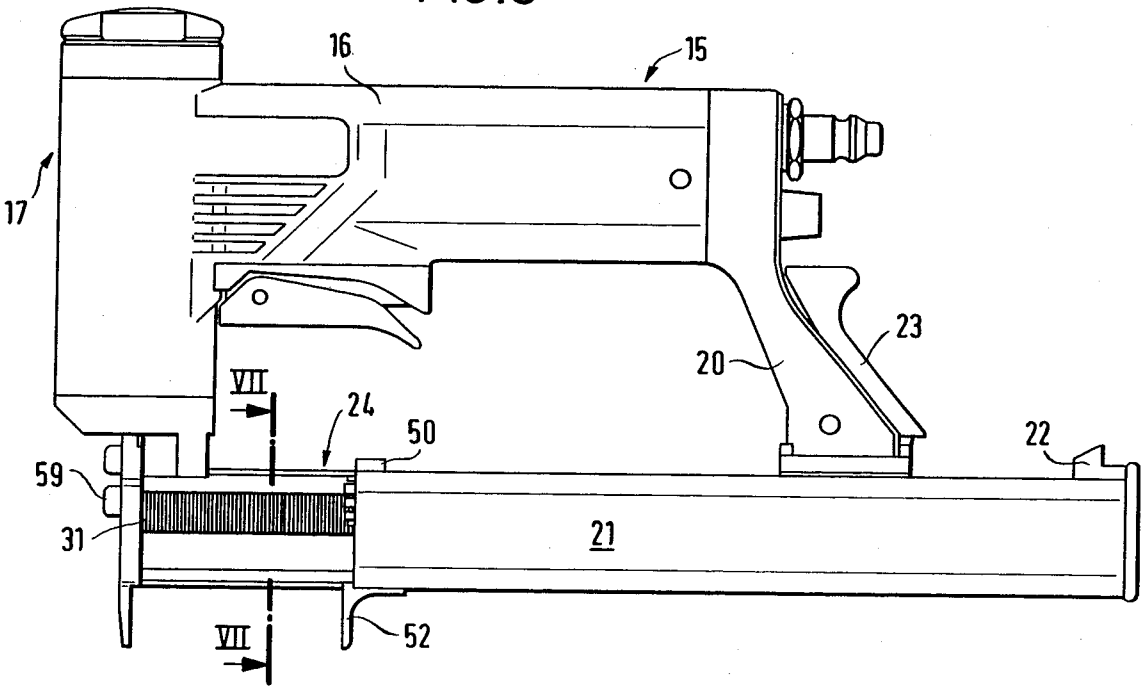
FIG. 5 shows a representation similar to FIG. 2, however, with the magazine loaded.
Figure 7:
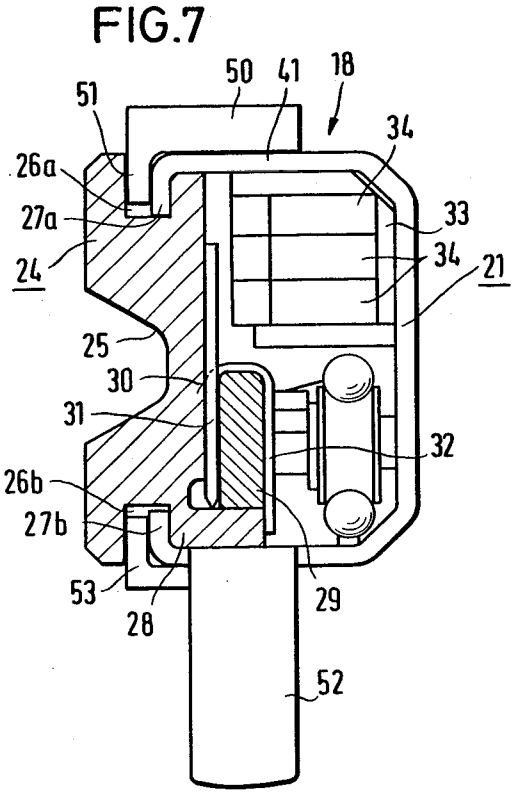
FIG. 7 shows a sectional view taken along line 7—7 of the representation shown in FIG. 5.
Figure 6:
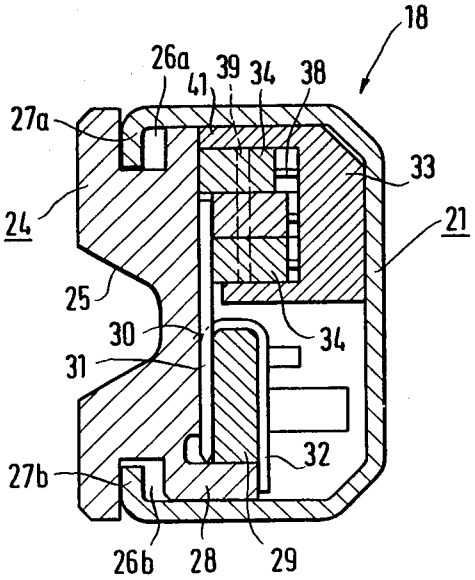
FIG. 6 shows a sectional view taken along line 6—6 of the representation shown in FIG. 1.
Figure 12:
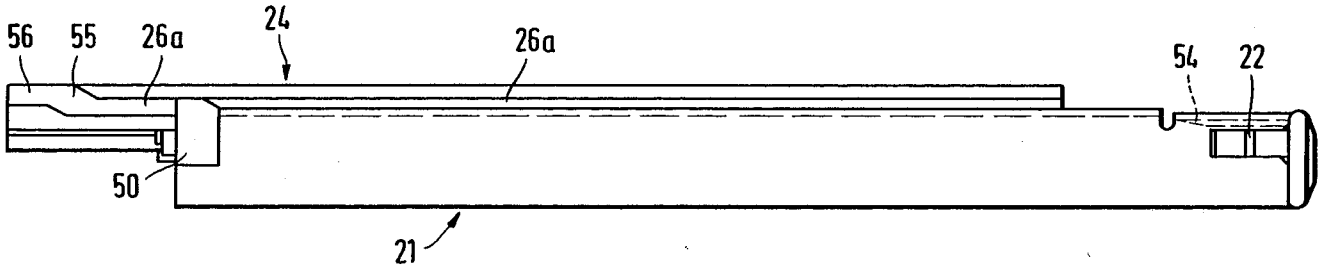
FIG. 12 shows a top plan view taken on the apparatus according to FIG. 2 in a direction towards member 12 with all parts omitted not belonging to the magazine.

It will be noted from FIG. 12 that an outstop 50 is arranged at the upper surface of the covering rail 21 at the front end thereof which cooperates with a rearward outstop 58 at the lower end of the holding member 20 and limits a displacement of the covering rail 21 towards the rear. As will be seen from FIG. 7, the outstop 50 comprises a portion 51 by which it projects into the groove **26*a*. The overall width of portion 51 and the free edge 27*a* of the covering rail 21 approximately corresponds to the width of the groove 26*a*. It will be noted from FIGS. 2 and 5 that the lower rearward portion 52 of the muzzle tool 19 is fixedly connected to the covering rail 21. From FIG. 7 it will be noted that a lug 53 is formed integrally with the tool portion 52 which engages within the lower groove 26*b*. The overall width of the lug 53 and the free edge 27*b* or the thickness thereof, respectively, approximately corresponds to the width of the groove 26*b*. From FIG. 12 it will furthermore be seen that the free edges 27*a*, 27*b* are thickened on the inside at the rear end thereof, as is shown at 54 in dashed lines. The groove 26*a* comprises a broader oblique portion 55 at the front end thereof, which terminates in a paraxial end portion 56** freely opening sideways.

Figure 2:
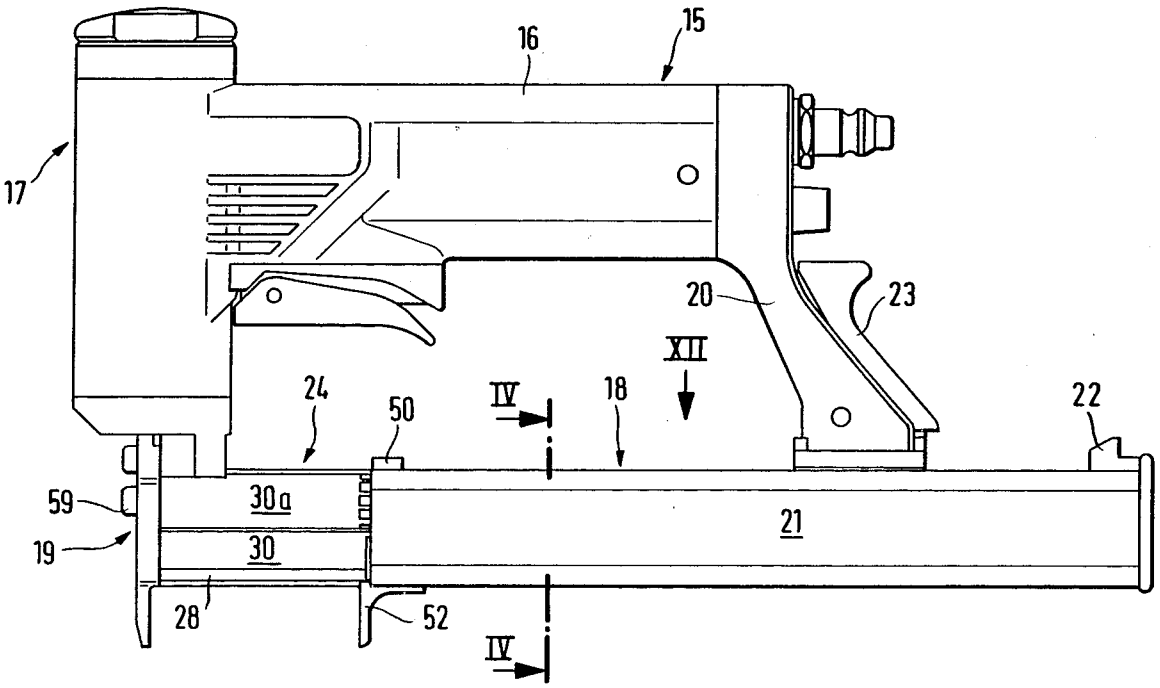
FIG. 2 shows the same view as FIG. 1 with the magazine partially opened.

In the position of the covering rail 21 as shown in FIGS. 2 and 12 there results an arrangement of the covering rail 21 corresponding to the sectional view of FIG. 4. All the laminations 34 are spaced from the opposite wall 30 through the same distance. If, however, the covering rail 21 is moved forward into the closed position, the groove portions 55, 56 of the grooves **26*a* and 26*b* as well as the thickened portions at the rear end will cause a certain lateral movement of the covering rail 21 in parallel with itself. This position may be recognized in FIG. 3. The laminations 34 lie close to the wall 30** contacting it.

Figure 13:
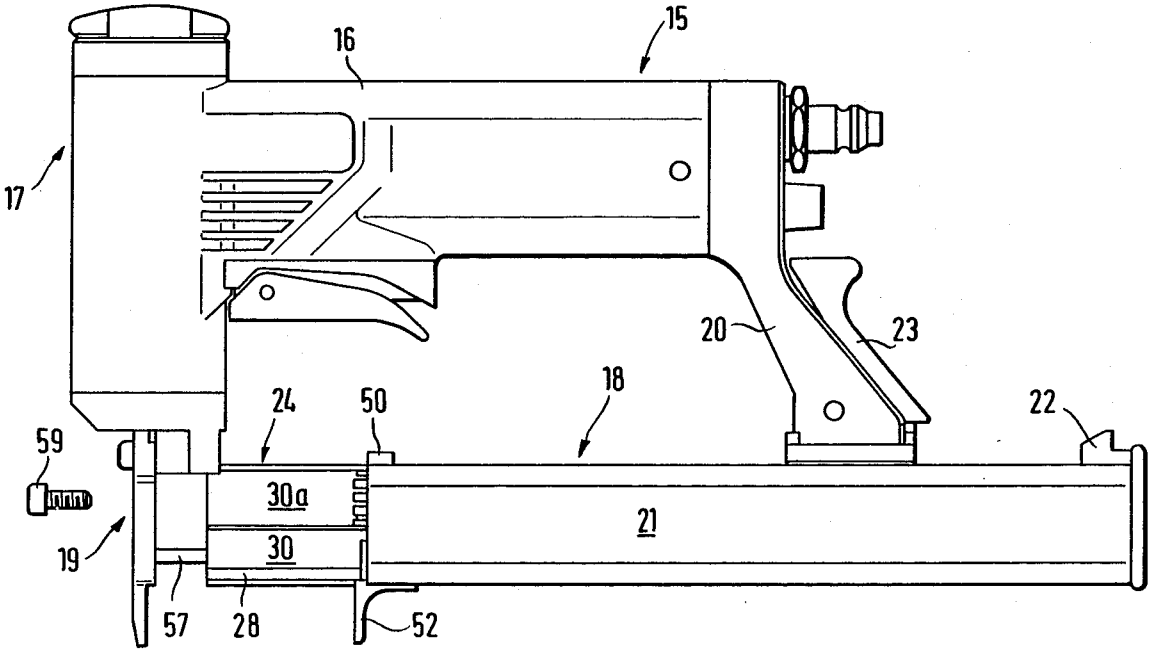
FIG. 13 shows a lateral view similar to FIG. 2, however, with the supporting structural member loosened.

With the covering rail 21 completely opened a strip of pins 31 may be placed into the magazine. This may be recognized from FIG. 7. The distance of the laminations 34 from the wall 30 is about one and a half to twice the diameter of the pins 30. After charging the rail 21 will again be pushed forward. Owing to the distance of the laminations 34 from the pins 31 this may be performed without any obstruction. At the moment when the covering rail 21 performs the transverse movement as described above, the laminations come to lie closely against the nails, i.e. as far as they are seized by the nails. In the representation according to FIG. 6 the length of the pins 31 corresponds to the height of the guiding channel approximately as far as the underside of the upper lamination 34. The two lower laminations, therefore, are urged inwards into the recess of the guiding member 33 a distance corresponding to the diameter of the pins 31. In this manner, the nails are guided laterally by the two lower laminations and are guided from above by the upper lamination 34. In the example of embodiment shown, the thickness of the laminations may be 3 mms. With the drive-in apparatus as shown, then, pin lengths of 12, 15, 18 and 21 mms may be processed. A manipulation in the magazine when changing the pin lengths in correspondance with the indicated values, therefore, is not necessary. The supporting structural member 24 abuts against the muzzle tool 19 at the inner surface thereof and is screwed thereto with the aid of a screw 59. If the screw 59 is loosened, as well as another screw in the region of the holding member 20, the supporting structural member 24 may be pulled to the rear a certain distance as is shown in FIG. 13. It will be noted that a pin guide 57 for the supporting structural member 24 cooperates with a bore in the supporting structural member 24. A screw connected to the holding member 20 extends through an elongated hole (not shown) of the supporting structural member, thereby enabling the displacement as described. In the arrangement of the supporting structural member as shown in FIG. 13 the drive-in channel (not shown) of the muzzle tool 19 is freely accessible, in order to remove jammed fasteners.

I claim:

1. A magazine for drive-in apparatus for driving pins or nails of the type having a guiding channel formed by spaced apart side, bottom and roof walls, wherein the roof wall may assume different heights above the bottom wall to accommodate different pin or nail lengths, and a spring-biased feeder for feeding the pins or nails in the guiding channel to a shooting channel in a muzzle tool, the magazine characterized in that (a) one side wall is formed by at least one lamination (34)
  (i) having a longitudinal surface (40),
  (ii) supported by a guiding structural member (33),
  (iii) capable of limited movement transverse to the longitudinal axis of the guiding channel, and
  (iv) selectively biased by spring means (38, 38*a*, 38*b*) towards the other side wall (30);

(b) a covering rail (21) forms a lateral boundary of magazine (18) and is longitudinally movable to
  (i) an open position for receiving a charge of pins or nails from the side of said magazine and
  (ii) a closed position for retaining the charge in the magazine; and (c) guide means (26*a*, 26*b*) formed in a supporting structural member (24)
  (i) permitting a longitudinal and transverse movement of the covering rail (21),
  (ii) and being interengaged with the lamination (34) such that
  (iii) in the open position the lamination (34) is held away from the other side wall (30) a distance greater than the diameter of the larger of shank and head of pins (31) or nails (42), and
  (iv) just before the closed position is reached the lamination (34) is urged towards the other side wall (30),
  (v) in order to obtain an automatic adaptation of the head of the roof wall to the respective length of the pin (31) or nail (42) by the operation of the covering rail (21).

2. A magazine according to claim 1, characterized in that the lamination (34) is supported in the guiding structural member (33) in the covering rail (21) and its longitudinal surface facing the guiding channel approximately is in alignment with a wall surface of the guide (33, 41) when the covering rail (21) is in its entirely or partially opened position.

3. A magazine according to claim 2 characterized in that two elongated holes (37*a*, 37*b*) spaced from each other are formed in the lamination (34*a*, 34*b*) with each elongation transversely oriented and receiving a pin (39) secured to the guiding member (33) and aligned substantially parallel to the other side wall (30).

4. A magazine according to claim 1, characterized in that the lamination (34*a*) is formed of metal and is provided with leaf springs (38*a*) at the ends thereof on the side facing away from the guiding channel.

5. A magazine according to claim 1, characterized in that the lamination (34*b*) is formed of synthetic material with a leaf spring (38*b*) or the like integrally formed therewith on the side facing away from the guiding channel.

6. A magazine according to claim 1 characterized in that the covering rail (21) is approximately C-shaped in cross section and has a pair of free edges (27*a*, 27*b*) guided in guide means (26*a*, 26*b*) of the supporting structural member (24).

7. A magazine according to claim 6, characterized in that the grooves (26*a*, 26*b*) over the major portion of the length thereof have a width which is greater than the thickness of the C-shaped covering rail(21) at the free edges, the grooves (26*a*, 26*b*) near the shooting channel comprising a portion (55,56) laterally offset with respect to the covering rail (21), and thickened portions (51, 53, 54) being arranged at the forward and rearward ends of the free edges (27*a*, 27*b*) of the covering rail (21), the thickness of which approximately corresponds to the width of the grooves (26*a*, 26*b*).

8. A magazine according to claim 7 wherein the forward upper thickened portion (15) characterized in that an outstop (50) fitted at the front end on the covering rail (21) has a portion (51) extending into the upper groove (26*a*).

9. A magazine according to claim 7 wherein the forward lower thickened portion is characterized in that a portion (53) of the muzzle tool (52) extends into the lower groove (26*b*).

10. A magazine according to claim 6, characterized in that the supporting structural member (24) further comprises a lateral lug (28) with the lower ends of the pins or nails standing thereon.

11. A magazine according to claim 10, characterized in that a guiding ledge (29) is arranged on the lug (28) for the spring biased feeder.

12. A magazine according to claim 6 characterized in that the supporting structural member (24) is guided at the front end by means of a relatively short guiding member (57) fitted to the muzzle tool (19) and is adapted to be fastened to drive-in apparatus (15) at the muzzle tool (19) with the aid of a screw (56), and the supporting structural member (24) is fastened in the rearward region to apparatus (15) by means of another screw received in an elongated hole in the supporting structural member (24).

13. A magazine according to claim 1, characterized in that the rearward portion (52) of the muzzle tool (19) is connected to the covering rail (21).

14. A magazine according to claim 1, characterized in that the side wall portion (30) opposite the laminations (34) comprises a deepening (30*a*) extending the length of the guiding channel.

* * * * *